US006112476A

United States Patent [19]

Schulenburg

[11] Patent Number: 6,112,476

[45] Date of Patent: Sep. 5, 2000

[54] MASONRY WEEP HOLE INSERT

[75] Inventor: Sally Schulenburg, Brookfield, Wis.

[73] Assignee: Masonry Accessories, LLC, New Berlin, Wis.

[21] Appl. No.: 09/358,336

[22] Filed: Jul. 21, 1999

Related U.S. Application Data

[63] Continuation-in-part of application No. 08/968,167, Nov. 12, 1997, abandoned.

[51] Int. Cl.[7] ..... E02D 31/02

[52] U.S. Cl. ..... 52/169.5; 52/302.1

[58] Field of Search ..... 52/169.5, 302.1, 52/302.3, 302.4, 442, 608, 610, 741.3, 741.13, 745.12, 747.1; 428/80, 81, 83, 121, 122, 131

[56] References Cited

U.S. PATENT DOCUMENTS

| | | | |
|---|---|---|---|
| 802,593 | 10/1905 | Peabody . | |
| 2,285,026 | 6/1942 | Fulcher . | |
| 2,329,627 | 9/1943 | Lang . | |
| 3,283,460 | 11/1966 | Patrick . | |
| 3,429,084 | 2/1969 | Brewer . | |
| 4,282,691 | 8/1981 | Risdon . | |
| 4,907,385 | 3/1990 | Biodrowski | 52/169.5 |
| 5,230,189 | 7/1993 | Sourlis . | |
| 5,343,661 | 9/1994 | Sourlis . | |
| 5,560,173 | 10/1996 | Scheiwiller . | |
| 5,598,673 | 2/1997 | Atkins . | |
| 5,713,696 | 2/1998 | Horvath et al. . | |
| 5,720,143 | 2/1998 | Soltis et al. . | |
| 5,768,842 | 6/1998 | Austin . | |
| 5,771,643 | 6/1998 | Parker | 52/169.5 |
| 5,794,388 | 8/1998 | Jackman | 52/169.5 |

*Primary Examiner*—Richard Chilcot
*Attorney, Agent, or Firm*—Boyle Fredrickson Ziolkowski S.C.; James F. Boyle

[57] ABSTRACT

A masonry weep hole insert for placement into a weep hole in a masonry wall, the weep hole being defined by a space without mortar between two adjacent bricks on a lower level of bricks for draining moisture and venting air from an airspace behind said masonry wall. The insert is so dimensioned so that a portion of the insert substantially fills the space between the two adjacent bricks which form the weep hole, and so that another portion extends rearwardly and upwardly above the weep hole into the airspace behind the bricks. In one embodiment, the insert, made from a porous material which is permeable to air and water but not mortar, is designed so that at least a portion of the porous material remains exposed to the airspace behind the brick veneer even in the event that mortar or other debris happens to fall into the airspace. The porous material thereby provides a passageway for draining moisture and venting air which will not become inadvertently blocked by excess mortar or debris. In the second embodiment, the insert, made from any easily formed rigid material, includes longitudinal slots that act as a passageway to connect the airspace to the outside environment.

12 Claims, 5 Drawing Sheets

MASONRY WEEP HOLE INSERT

RELATED APPLICATION

The present application is a continuation-in-part application of Ser. No. 08/968,167 filed on Nov. 12, 1997 and now abandoned.

BACKGROUND OF THE INVENTION

1. Field of the Invention

The present invention relates to a device for preventing mortar and other debris from blocking a weep hole in a masonry wall, and in particular, to an insert which can be placed in a weep hole formed by a space between two adjacent bricks or blocks of a masonry wall in order to prevent blockage of the weep hole and thereby assure proper drainage and venting of the wall.

2. Background of the Related Art

An exterior masonry wall of a building normally has two wall components to it, an exterior masonry veneer and an insulated interior wall. The interior wall is typically constructed with a wood frame, dry wall, insulation and other components. The interior wall may alternatively be made of concrete or other suitable materials. The "outer" surface of the interior wall is often covered with a weatherproof membrane and flashing to prevent moisture from seeping into the interior of the building. The brick veneer is actually constructed a short distance away from the interior wall so that there is a small cavity or airspace between the back of the brick veneer and the outer surface of the interior wall. Unfortunately, during construction and afterwards, moisture from rain, seepage or condensation often becomes entrapped in the airspace between the brick veneer and the interior wall. For this reason, the brick veneer is provided with what is known in the trade as a "weep hole."

A weep hole is merely a passageway at or near the bottom of the brick veneer for draining moisture from the airspace to the exterior of the brick wall. A weep hole is most commonly formed by making a small gap or space without mortar between two bricks on the bottom course of bricks. A weep hole also serves the function of venting air in order to equalize the air pressure in the airspace between the interior and exterior walls with the atmospheric pressure. Such weep holes unfortunately tend to become clogged with mortar during construction. In other words, as the mason adds additional courses of brick to build the wall upward, excess mortar falling into the airspace behind the bricks may plug the weep holes.

A number of devices have been developed for ensuring drainage of moisture through weep holes in masonry walls. For example, U.S. Pat. No. 2,329,627 to G. R. Lang relates to a drain pipe for a masonry wall which includes a set of ribs for seating the pipe in the proper position. U.S. Pat. No. 3,429,084 issued to B. Brewer discloses a Z-shaped tube having a screen and an ant trap chamber which provides circulation of air and drainage of condensation between walls yet prevents insects from entering behind the wall. U.S. Pat. No. 4,282,691 issued to David G. Risdon discloses a weep hole device comprised of a tube of sufficient length to transverse the cross section of the wall and a wick which extends through the tube and upwardly behind the wall. U.S. Pat. Nos. 5,230,189 and 5,343,661 issued to Tom Sourlis discloses blocks of fibers or screens used to catch falling mortar and prevent it from blocking weep holes. Such devices have unfortunately been found to be too flimsy, cumbersome, expensive or otherwise ineffective.

Accordingly, an effective device for preventing mortar and debris from blocking a weep hole in a brick wall is desired.

SUMMARY OF THE INVENTION

The present invention of a weep hole insert for masonry walls is comprised of a substantially L-shaped body in which one portion fits within the space between two adjacent bricks which define the weep hole, and a second portion which extends behind and above the weep hole in the airspace between the back side of the brick veneer and the interior wall.

In one embodiment, a porous weep hole insert for preventing mortar and debris from blocking a weep hole in a brick wall is disclosed. The device is made from a porous material which will not absorb mortar, but will allow water and air to pass through it.

In a second embodiment, a molded weep hole insert for preventing mortar and debris from blocking a weep hole in a brick well is disclosed. Rather than utilizing porous characteristics to allow the flow of air and water to flow through it, the second embodiment contains slots that extend transversely between the airspace and the exterior of the brick wall. Moisture and air flow through the slots from the airspace to the exterior of the brick wall.

The two disclosed embodiments of the weep hole inserts presented herein are so dimensioned such that, even if mortar unintentionally falls behind the brick wall into the airspace, at least a portion of the device will remain exposed to the airspace and thereby provide a passage through either the porous material or the slots for draining water and moisture from the airspace behind the brick wall to the exterior of the building, and also to vent air between the airspace and outside atmosphere.

Consequently, the primary objects of the invention are to provide a device for preventing mortar and debris from blocking a weep hole in a brick wall; to provide a device which fits within a weep hole defined by a space between two adjacent bricks for draining moisture from behind the brick wall to the exterior of the building; to provide a device that is impermeable to mortar while permitting air and water to flow through it; and to provide a device which is small and easy to use during the construction of a brick wall in order to ensure that the wall provides proper drainage of moisture and venting of air.

Other objects and advantages of the invention will become apparent from the following description, which taken in conjunction with the accompanying drawings, set forth by way of illustration and example certain preferred embodiments of this invention.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

Figure 1:
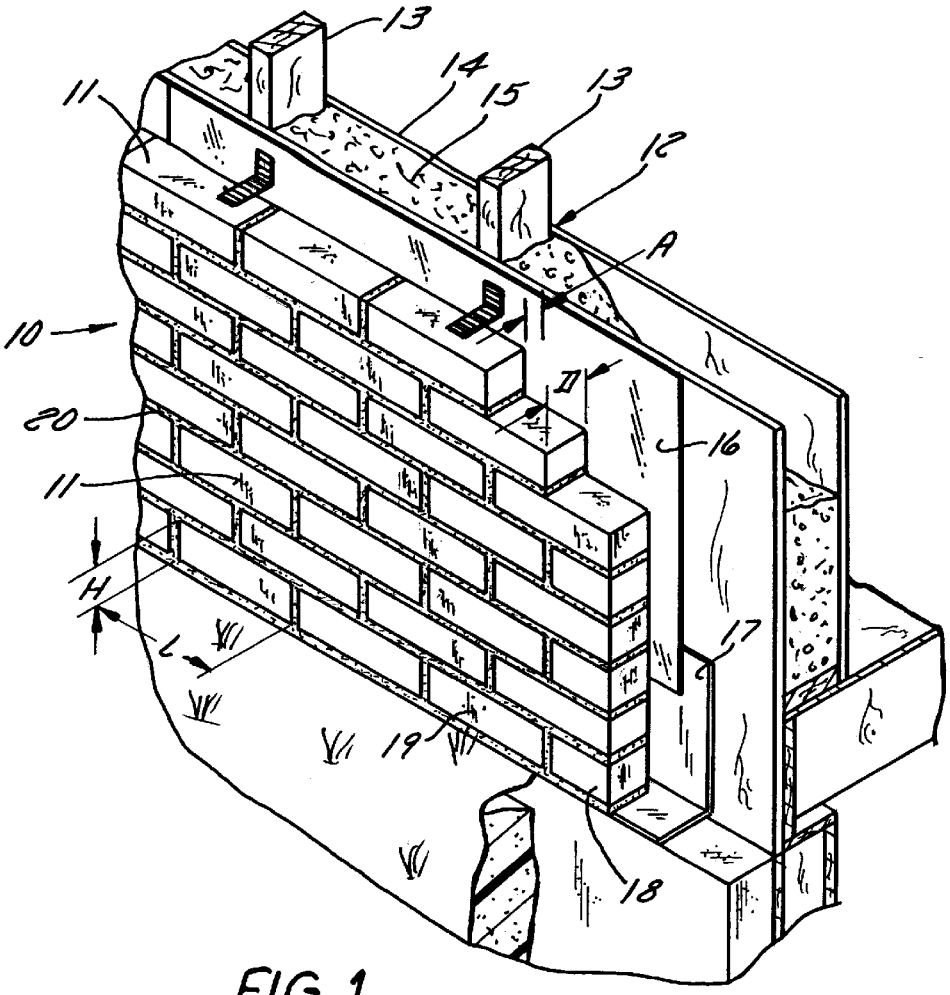
FIG. 1 is a partial sectional view of a typical masonry wall which contains an airspace between a brick veneer and an insulated interior wall with a weep hole for draining moisture and venting air from the airspace to the exterior of the building.

Referring to FIG. 1, a masonry wall 10 for the exterior of a building is comprised of a brick veneer 11 and an insulated interior wall 12. The brick veneer 11 is constructed from a plurality of bricks or blocks arranged in a vertical pattern in order to construct the wall. Each brick is of a substantially rectangular shape having a uniform length L, height H and depth D. The brick veneer 11 is built up by placing one layer of bricks over another layer, with the upper layer vertically offset from the lower layer by a distance of approximately one-half the length L of a brick. Thus, as shown in FIG. 1, a brick on one layer is positioned directly over the space between two bricks on the layer immediately beneath it. The spaces between adjacent bricks and between adjacent layers of bricks is filled with mortar 20.

The insulated interior wall 12 is comprised of wood framing 13, dry wall 14, insulation 15 and a weather proofing membrane 16 and flashing 17. Of course, other materials may be used. In any event, the building wall is constructed so that there is a small cavity or airspace A between the back side of the brick veneer 11 and the outer surface of the interior wall 12. The airspace A between the back side of the brick veneer and the surface of the interior wall is usually at least about one to two inches deep, although the exact dimension may vary depending upon the nature of the construction.

As discussed, a small passage known as a weep hole W is formed at the bottom of the brick veneer for draining moisture and venting air from the airspace to the exterior of the wall. Moisture may accumulate from a number of sources, such as rain water dropping into the airspace during construction, seepage through cracks in the wall which may develop after construction has been completed, but most often through ordinary condensation. Weather changes also cause changes in atmospheric air pressure, so the weep hole serves the additional purpose of providing an air passageway for equalizing the pressure in the airspace behind the wall with the atmospheric pressure.

A weep hole is most easily formed by simply spacing two adjacent bricks 18 and 19 on the lower course a short distance apart, and placing no mortar in the space between the two bricks. In other words, the weep hole W is defined by the space between the two adjacent bricks 18 and 19, and consequently the weep hole W has a height equivalent to the height H of the brick, a depth D equivalent to the depth of the brick, and a width equivalent to the distance of the space between two adjacent bricks. Specific dimensions of the weep hole are naturally dependant on the specific dimensions of the brick used to construct the wall.

As mentioned, during construction mortar and other debris tend to fall into the airspace A between the brick veneer 11 and the interior wall 12, sometimes enough of it to block the weep hole W, which would defeat the purpose of even having one. The present invention is specifically designed to prevent such blockage from occurring.

Figure 2:
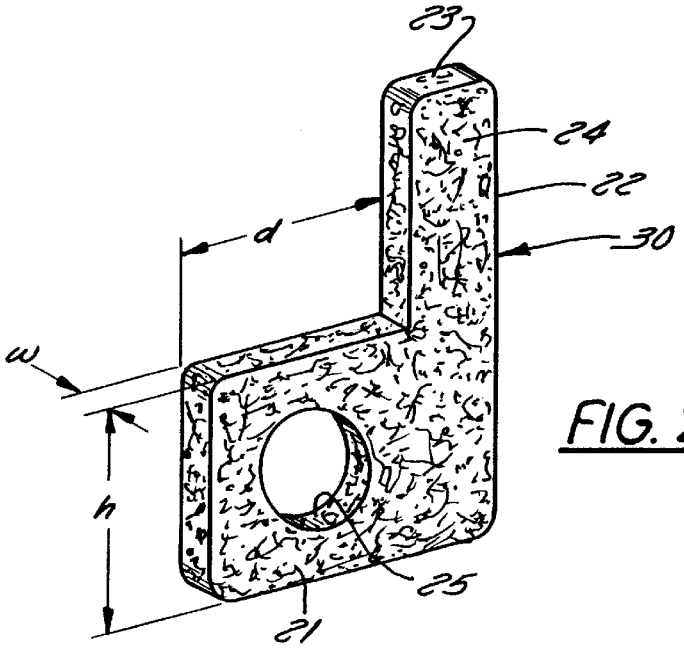
FIG. 2 is a perspective view of the porous masonry weep hole insert in accordance with a first embodiment of the present invention.
Figure 3:
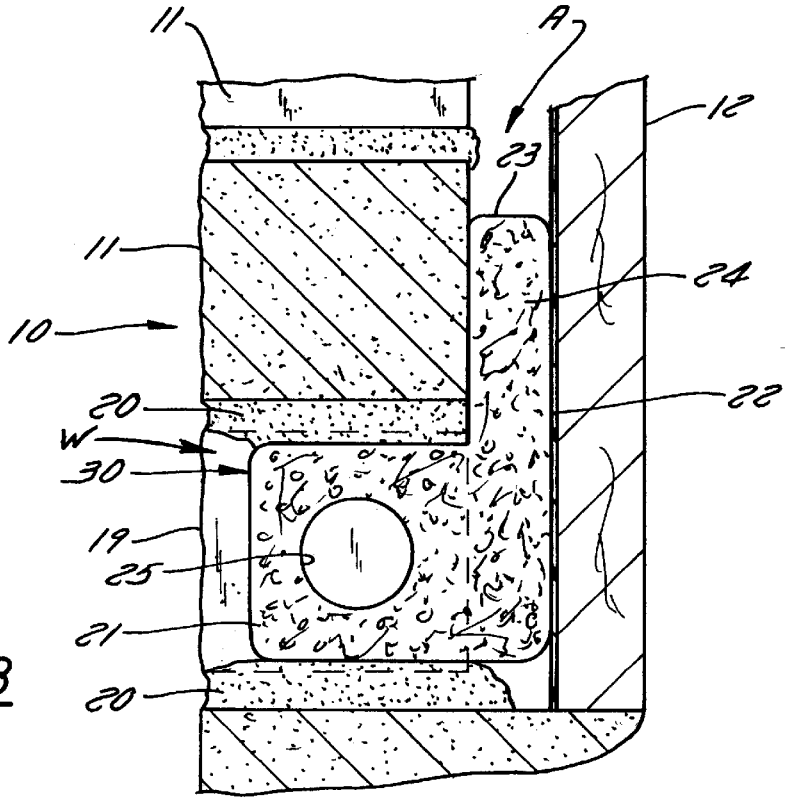
FIG. 3 is a cross-sectional view of the masonry wall with the porous weep hole insert of FIG. 2 placed within a weep hole.
Figure 4:
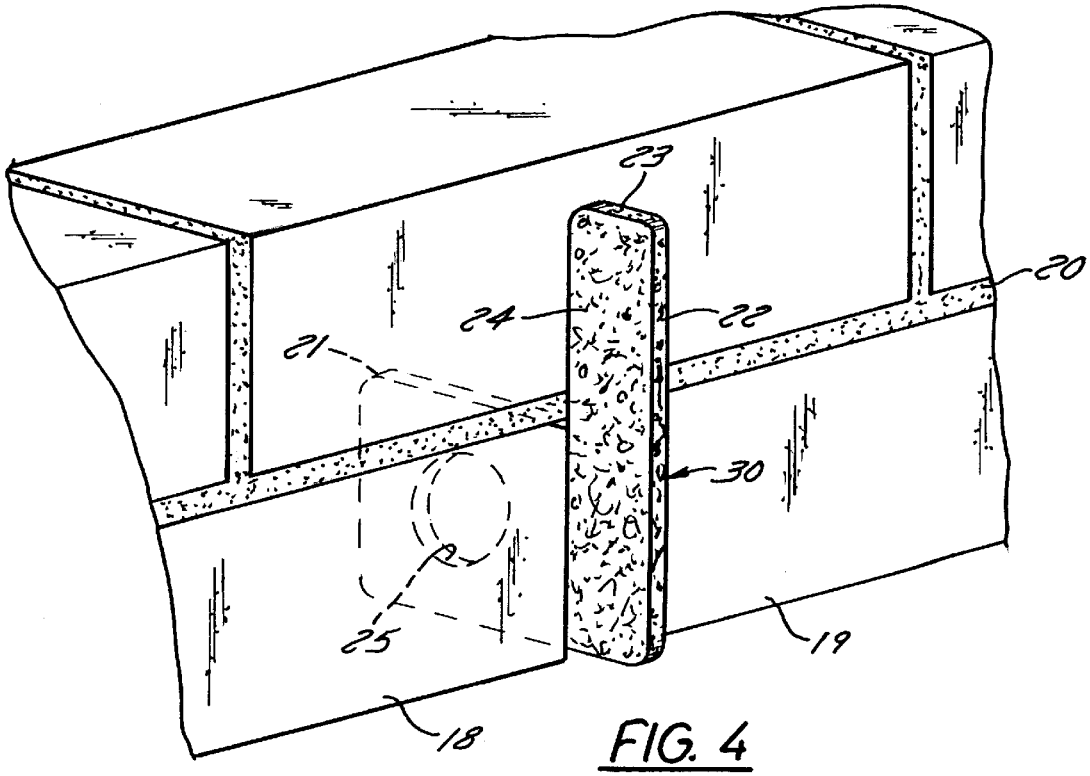
FIG. 4 is a perspective view of the back side of the brick veneer showing the porous weep hole insert of FIG. 2 placed within a weep hole.
Figure 5:
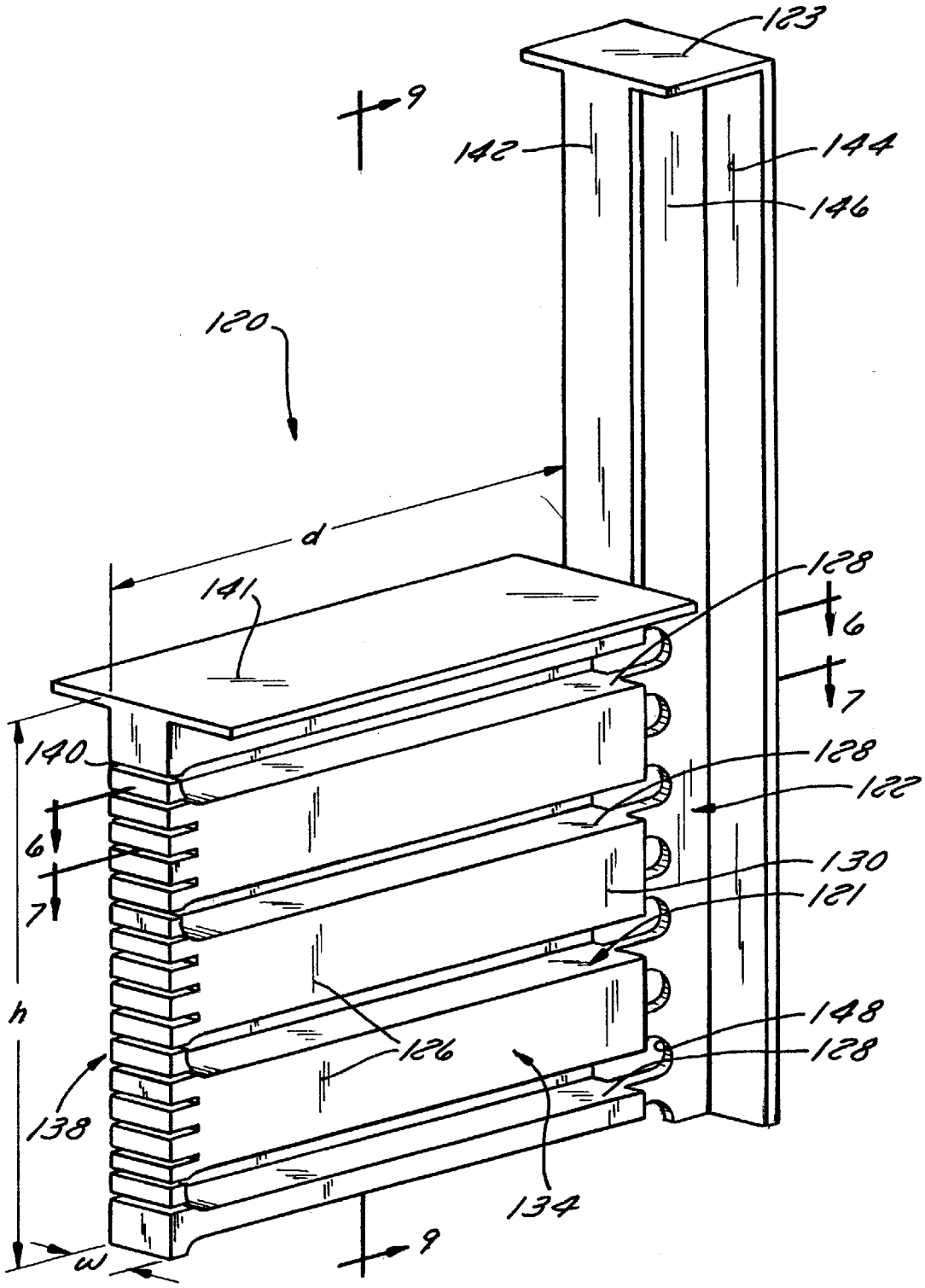
FIG. 5 is a perspective view of the masonry weep hole insert in accordance with a second embodiment of the present invention.
Figure 6:
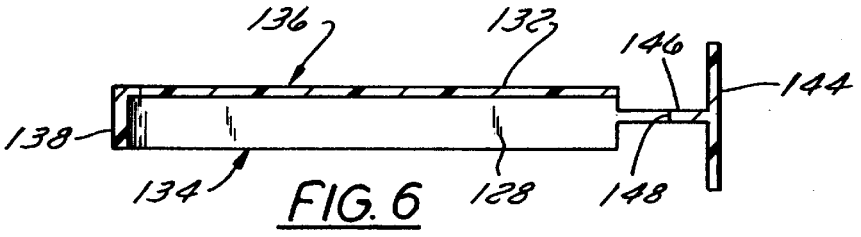
FIG. 6 is a sectional view taken along section 6—6 of FIG. 5.
Figure 7:
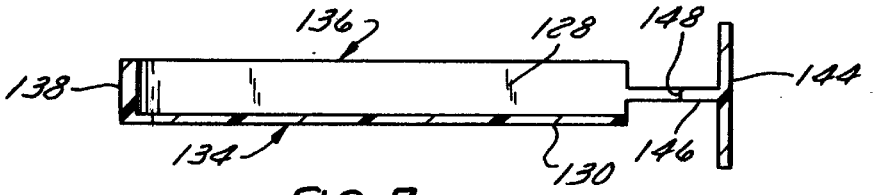
FIG. 7 is a sectional view taken along section 7—7 of FIG. 5.
Figure 8:
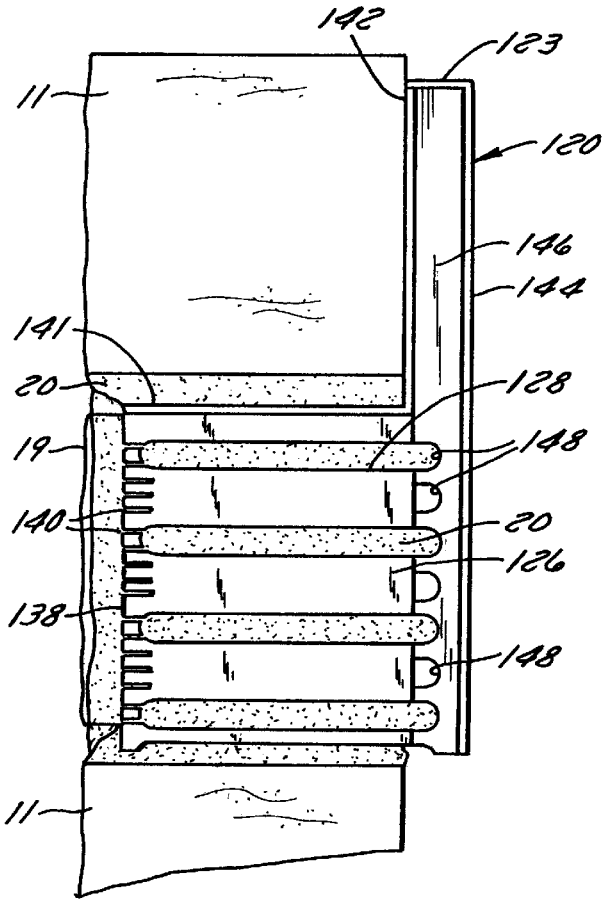
FIG. 8 is a side elevation view of the weep hole insert of FIG. 5 inserted into a weep hole.
Figure 9:
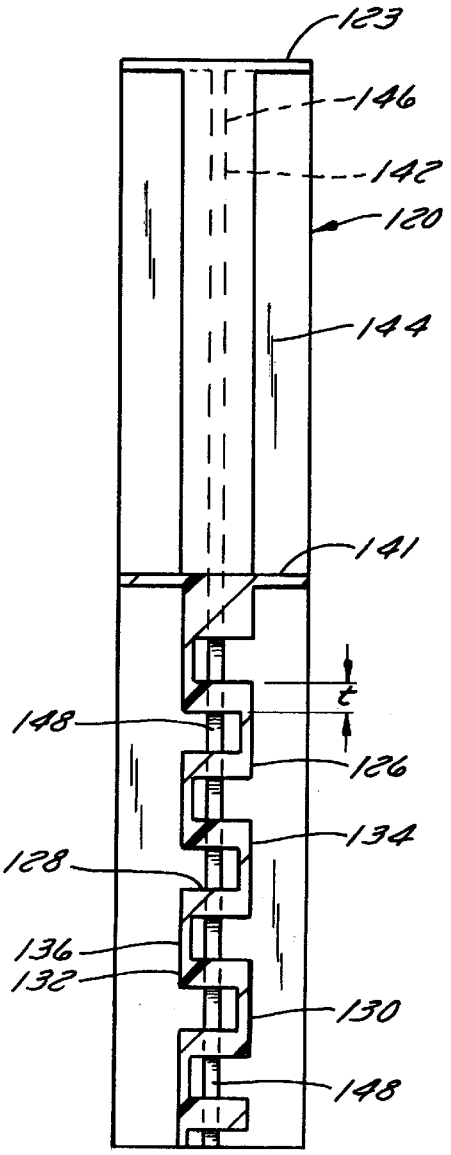
FIG. 9 is a sectional view taken along section 9—9 of FIG. 5.
Figure 10:
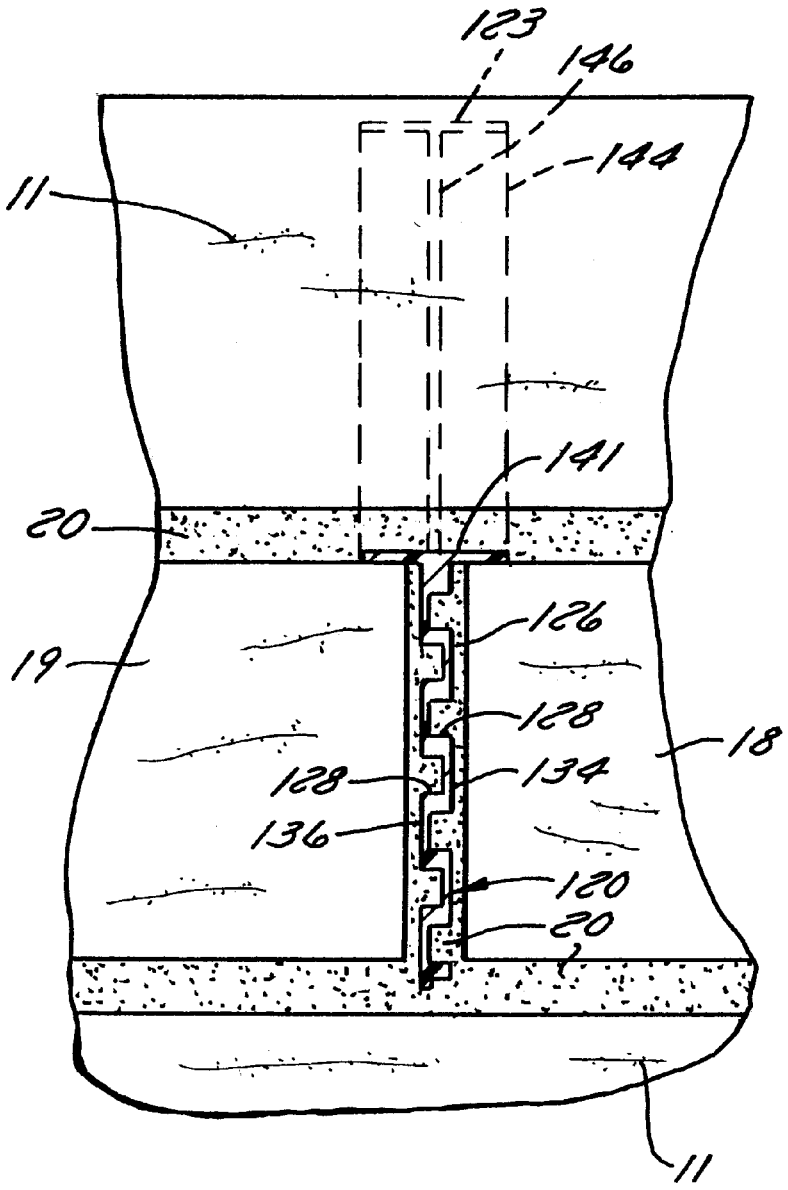
FIG. 10 is a elevated front view of the weep hole insert of FIG. 5 inserted into a weep hole.

Referring to FIGS. 2, 3 and 4, the weep hole insert 30 in accordance with a first embodiment of the present invention comprises a relatively flat substantially L-shaped body having a first portion 21 and a second portion 22. The width w of the device is substantially the same as the width of the weep hole. Additionally, the first portion 21 of the device has a height H which is substantially equivalent to the height h of the weep hole and has a depth D which is substantially equivalent to the depth d of the weep hole.

The second portion 22 of the device is an elongated section which extends from the first portion rearwardly into the airspace A behind the brick, and also extends upwardly a substantial distance above the height of the weep hole. During construction the device is placed in the wall so that the first portion 21 fits within the space between the two bricks on the lower course which form the weep hole W, and the second portion 22 fits in the airspace A behind the brick.

The device 20 is preferably made from a sufficiently rigid, porous material through which air and water can pass through but not mortar or cement. In this context, "porous material" is intended to mean any porous, fibrous or other equivalent material which is permeable to both air and water, but will not absorb mortar of the type commonly used in masonry work. The device is preferably made of a fully cindered reticulated ceramic foam. Alternatively, the device may be made from a durable nonwoven, nonwicking, modified polyester (e.g., GAF Cobra® Ridge Vent or other equivalent). Of course other equally suitable materials may be substituted.

The weep hole insert 20 of the first embodiment may also optionally be provided with an opening 25 in the center of the device as shown in FIG. 2, which reduces the amount of material necessary to fabricate the device, reduces shipping and handling weight, and reduces the resistance of water and air passing through the device. Finally, the pores in the material should also be small enough to prevent insects from infesting the interior wall through the weep hole.

In the event that excess mortar or other debris should fall into the airspace behind the brick veneer, some of the mortar may land on the very top surface 23 of the second portion of the device, and some mortar may land on the bottom of the flashing and accumulate upwards along the lower portion of the side of the device. However, the device is specifically designed so that at least a portion of the vertical surface 24 of the porous material should remain exposed to the airspace between the back side the brick veneer and the interior wall. Because the porous material is both air and water permeable, there will always be a pathway for draining moisture and venting air through the weep hole.

A weep hole insert in accordance with a second embodiment of the present invention will now be described in detail. Referring to FIGS. 5–10, the insert 120 comprises a relatively flat L-shaped body having a first portion 121 and a second portion 122. The width w of the insert 120 is substantially the same as the width of the weep hole. Additionally, the first portion 121 of the device has a height h which is substantially equivalent to the height of the weep hole and has a depth d which is substantially equivalent to the depth of the weep hole.

The first portion 121 is comprised of a substantially rectangular wall 126 having a first set of transversely running slots 128 on both sides, staggered apart from each other on the opposite side of the wall 126 by a distance t. In other words, a slot on a first side 134 of the wall 126 is created, and slots are also created on a second side 136 of the wall 126 spaced from the slot on the front side by a distance t upwardly and downwardly from the slot on the front side 138. In essence, walls defining front rectangular portions 130 and rear rectangular portions 132 are created. The slots 12 extend from the back to the front to provide air and water passageways from the airspace behind the brick veneer to the exterior of the wall. In this preferred embodiment, the first set of slots 128 are all of substantially the same height. The first set of slots 128 open to the outside environment via a second set of slots 140 in the front wall 138 of the insert 120. The first portion 121 also comprises an upper surface 141 that overhangs from the first and second sides, 136 and 138, respectively. When installed in a weep hole, the upper surface 141 rests on top of two adjoining bricks so that, while the mortar is being installed, the position of the insert 120 is relatively fixed. The upper surface 141 also prevents mortar from dropping into the slots 128 and blocking the weep hole.

The second portion 122 of the insert 120 is substantially an I-beam section with a first wall 142, a second wall 144, and middle wall 146. First wall 142 terminates at the ceiling 123 and substantially semicircular cutout portions 148 exist in the middle wall 146 aligned with slots 128 to provide passageways for the air and moisture from the airspace into the slots 128 and thus into the environment. As a result, air and water accumulating in the interior of the masonry wall 10 are able to flow to the exterior via the cutout portions 148, slots 128, and slots 140. The very top surface 123 exists so that, in case excess mortar or other debris should fall into the airspace behind the brick veneer, some of the mortar may land on the top surface 123, while some may land on the bottom of the flashing. However, the insert is designed such that a pathway will always exist for draining moisture and venting air through the weep hole.

The insert in accordance with the second embodiment is preferably comprised of an injection molded plastic material. Injection molded plastics are relatively inexpensive to produce and are sufficiently strong rigid to successfully function in the surrounding environment. While injection molded plastic is preferred, any material that is resilient to the surrounding conditions of a weep hole insert, that can be molded or otherwise formed into the necessary shape, and that is of sufficient rigidity and strength may be used in accordance with this preferred embodiment.

Although the weep hole inserts disclosed herein have been described with specific reference to certain dimensional parameters, such parameters may change depending upon the nature of the construction. Therefore, specific structural details disclosed above are not intended to limit the scope of the invention, but merely for a basis for the claims and for teaching one skilled in the art to variously employ the present invention in any appropriately detailed manner. Changes may be made in the details of the structure or material from which the invention is made without departing from the spirit of the invention, especially as defined in the following claims.

I claim:

1. A device insertable into a weep hole in a brick wall of a building and designed for use in preventing mortar and debris from blocking said weep hole said weep hole defined by a space without mortar between two adjacent bricks for draining moisture from an airspace behind said brick wall to the exterior of said building, said brick wall being composed of a plurality of substantially rectangular shaped bricks with each brick having a substantially uniform length L, height H and depth D, said weep hole having a height h substantially equivalent to the uniform height H of said bricks, a width w equivalent to the distance of the space without mortar between two adjacent bricks and a depth d substantially equivalent to the uniform depth D of said bricks, said insertable device comprising:

a substantially flat L-shaped body having a first portion and a second portion;

said first portion having a height h', width w' and depth d' substantially equivalent to the height h, width w and depth d, respectively, of said weep hole for placement of said first portion into said space, said first portion including a front wall surface exposed to the exterior of said buildings;

said second portion extending rearwardly from said first portion into said airspace and extending upwardly above said height of said first portion, said second portion including first and second vertical surfaces exposed to the airspace behind the brick wall; and, said L-shaped body being made from a porous material, said porous material being permeable to air and water but impermeable to mortar, said body thereby comprising a multiplicity of air and water passageways extending from the vertical surfaces on the second portion to the exposed front wall surface on the first portion;

whereby moisture from said airspace may drain through said porous material and out through said weep hole to the exterior of the building.

2. The device of claim 1, wherein the second portion of the L-shaped body has a width equal to the width w' of the first portion.

3. The device of claim 1, wherein the first portion has a central opening extending through the width w' of said first portion.

4. The device of claim 2, wherein the second portion further comprises an upper surface which extends above the height of the weep hole for catching mortar and debris which may fall from above into said airspace said upper surface being impermeable to mortar.

5. The device according to claim 1, wherein the porous material comprises a reticulated ceramic.

6. The device according to claim 1, wherein the porous material comprises a nonwoven, nonwicking, fibrous plastic.

7. A device insertable into a weep hole in a masonry wall for preventing mortar and debris from blocking said weep hole, said masonry wall comprising a brick veneer and an insulated interior wall, said brick veneer comprising a plurality of bricks stacked in a vertical pattern, each brick being of a generally rectangular shape and having a relatively uniform length L, height H and depth D, said weep hold defined by a space without mortar between two adjacent bricks for draining moisture from an airspace behind said brick veneer to the exterior of said masonry wall, said insertable device comprising:

a body having a first portion and a second portion;

said first portion having height h substantially equivalent to the height H of said brick, a depth d substantially equivalent to the depth D of said brick, and a width w substantially equivalent to the distance of the space between said two adjacent bricks for placement of said first portion into said weep hole, said first portion including a front wall surface exposed to the exterior of said masonry wall;

said second portion extending from the first portion rearwardly and upwardly into the airspace behind said brick veneer, said second portion including a top surface impermeable to mortar, and said second portion further including first and second vertical surfaces exposed to the airspace behind the brick veneer; and, said insertable device including a plurality of pathways extending from the first and second vertical surfaces on the second portion to the exposed front wall surface on the first portion for providing fluid communication between the airspace behind the brick veneer and the exterior of the masonry wall.

8. The device of claim 7, wherein the body is a substantially L-shaped body comprised of a porous material permeable to air and water but impermeable to mortar.

9. The device of claim 8, wherein the porous material comprises a reticulated ceramic.

10. The device of claim 8, wherein the porous material comprises a nonwoven, nonwicking fibrous plastic.

11. The device of claim 7, wherein the first portion has a first upper surface, said first upper surface extending laterally above said two adjacent bricks, and the second portion has a second upper surface which extends a substantial distance above said first upper surface and extends laterally over the first and second vertical surfaces of the second portion.

12. A device for preventing mortar and debris from blocking a weep hole in a brick wall of a building, said weep hole defined by a space without mortar between two adjacent bricks for draining moisture from an airspace behind said brick wall to the exterior of said building, said weep hole having a height, width and depth, said device being insertable into said weep hole and comprising:

an L-shaped body having a first portion and a second portion;

said first portion having a height, width and depth substantially equivalent to the height, width and depth, respectively, of said weep hole for placement of said first portion into said space, said first portion including a front wall surface exposed to the exterior of said building;

said second portion extending rearwardly from said first portion into said airspace and extending upwardly above said height of said first portion,.

said second portion including a top surface impermeable to mortar and said second portion further including first and second vertical surfaces exposed to the air space behind the brick veneer;

said first portion further including a plurality of staggered transverse slots extending from the first and second vertical surfaces of said second portion of said device forwardly to said exposed front wall of said first portion, said slots providing fluid communication from said second portion to said front face.

* * * * *